US010654068B2

(12) United States Patent
Whiting et al.

(10) Patent No.: US 10,654,068 B2
(45) **Date of Patent: *May 19, 2020**

(54) PORTABLE INDUCTION ELECTROSPRAYING APPARATUS AND METHOD

(71) Applicant: ELECTROSTATIC SPRAYING SYSTEMS, INC., Watkinsville, GA (US)

(72) Inventors: Richard Bruce Whiting, Watkinsville, GA (US); Cameron D. Hobbs, Watkinsville, GA (US); Joel S. Hayes, Madison, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/871,650

(22) Filed: Jan. 15, 2018

(65) Prior Publication Data

US 2018/0133750 A1 May 17, 2018

Related U.S. Application Data

(63) Continuation of application No. 14/879,745, filed on Oct. 9, 2015, now Pat. No. 9,901,954.

(60) Provisional application No. 62/147,366, filed on Apr. 14, 2015, provisional application No. 62/131,592, filed on Mar. 11, 2015, provisional application No. 62/061,771, filed on Oct. 9, 2014.

(51) Int. Cl.

| | |
|---|---|
| ***B05D 1/04*** | (2006.01) |
| ***B05B 9/08*** | (2006.01) |
| ***B05B 1/20*** | (2006.01) |
| ***B05B 5/03*** | (2006.01) |
| ***B05B 5/16*** | (2006.01) |
| ***B05B 5/08*** | (2006.01) |
| *F02B 63/00* | (2006.01) |

(52) U.S. Cl.

CPC ..... *B05D 1/04* (2013.01); *B05B 1/202* (2013.01); *B05B 5/03* (2013.01); *B05B 5/08* (2013.01); *B05B 5/1691* (2013.01); *B05B 9/08* (2013.01); *F02B 63/00* (2013.01)

(58) Field of Classification Search

CPC .. B05B 5/00; B05B 5/08; B05B 1/202; B05B 5/03; B05B 5/1691; B05B 9/08; B05D 1/04; F02B 63/00

USPC ..... 239/690, 690.1, 152–154

See application file for complete search history.

(56) References Cited

U.S. PATENT DOCUMENTS

| | | | | |
|---|---|---|---|---|
| 5,208,030 | A * | 5/1993 | Hoy | A01N 25/34 424/405 |
| 5,240,186 | A * | 8/1993 | Dobbins | B05B 5/03 239/154 |
| 5,893,495 | A * | 4/1999 | Godshaw | A45F 3/04 190/115 |
| 6,161,739 | A * | 12/2000 | Bentzen | A45F 3/08 224/153 |
| 6,305,048 | B1 * | 10/2001 | Salisian | A47L 5/36 15/326 |
| 9,901,954 | B2 * | 2/2018 | Whiting | B05B 5/08 |
| 2013/0277463 | A1 * | 10/2013 | Baltz | B05B 12/002 239/692 |
| 2014/0209705 | A1 | 7/2014 | Bahr et al. | |
| 2015/0050532 | A1 * | 2/2015 | Waigel | H04M 2/1005 429/61 |

(Continued)

*Primary Examiner* — Jason J Boeckmann

(74) *Attorney, Agent, or Firm* — Smith Tempel Blaha LLC; Matthew T. Hoots

(57) ABSTRACT

Low form factor mobile electrostatic spray units and methods of using same are disclosed.

8 Claims, 11 Drawing Sheets

(56) References Cited

U.S. PATENT DOCUMENTS

2015/0228940 A1* 8/2015 Fujisawa ..... A45C 11/00
429/99

* cited by examiner

PORTABLE INDUCTION ELECTROSPRAYING APPARATUS AND METHOD

CROSS-REFERENCE TO RELATED APPLICATIONS

This is a utility patent application being filed in the United States under Title 35 U.S.C. § 100 et seq. and 37 C.F.R. § 1.53(b) as a non-provisional continuation of the application entitled "PORTABLE INDUCTION ELECTROSPRAYING APPARATUS AND METHOD," filed on Oct. 9, 2015 and assigned application Ser. No. 14/879,745 and, therefore, claims priority under 35 U.S.C. § 119(e) to each of U.S. provisional application Ser. No. 62/061,771, filed Oct. 9, 2014; U.S. provisional application No. 62/131,592, filed Mar. 11, 2015; and U.S. provisional application No. 62/147,366, filed Apr. 14, 2015. The entire contents of each of Ser. No. 14/879,745, 62/061,771, 62/131,592 and 62/147,366 are hereby incorporated by reference.

BACKGROUND

High spray efficiency and quality of coating applications is important for many industries and for numerous reasons. For example, in the realm of agricultural production, poor quality agrochemical coverage of crops equates to increased pest damage and yield losses. Additionally, off-target movement of pesticides due to drift or runoff may cause environmental pollution of ground water, surface water or air. This could result in pesticide poisonings and other unintended ecological and economic harm. Inadequate mass transfer also wastes significant quantities of chemicals. The end result is that the agricultural producer's financial bottom line suffers due to unnecessarily high costs of chemicals, fuel, equipment and labor. An example from the realm of public health revolves around the effectiveness of spray disinfection and sanitation procedures. Insufficient coverage of human contact surfaces by standard spray equipment has contributed to the large increase in hospital acquired infections such as Methicillin Resistant *Staphylococcus Aureus* (MRSA) and *Clostridium difficile* as well as the spread of communicable infectious diseases on a wide scale such as SARS, Norovirus, influenza and tuberculosis to name just a few. The cost in such circumstances is great financially as well as in human suffering and lives.

Traditional hydraulic spraying technologies are notoriously inefficient in the mass transfer of sprayed material onto an intended target. Additionally, the material that impacts the target often provides only spotty coverage. Typically, surfaces which are in the direct line of the spray stream or cloud receive a majority of the spray and obscured areas such as the backs and undersides of the target receive almost no coverage. Spray material which doesn't adhere to the target often runs off onto the ground or persists as small droplets in the air which can be easily carried off-site or be inhaled by people in the vicinity of the spray event.

Standard art hydraulic sprayers generally work on the principle of providing high pressure liquid and air flows to a plurality of mechanically atomizing nozzles. The spray of droplets emitting from the nozzles convey relatively high volumes of liquids to an intended target. Inefficiencies in the range of 16-50% stem from the basic inertial, aerodynamic and physical forces of the spray stream. Nozzles on these hydraulic sprayers generally produce large droplets, typically in the range of 100-600 microns in diameter. Such large droplets lead to variable and uneven coverage on target surface. Large droplets are also much more likely to bounce off of or run off of a target and fall to the ground. Agricultural research has shown that traditional hydraulic sprayers apply significantly less material to undersides of leaves and interior portions of target plants than to the adaxial portions of leaves growing on the exterior of the plant canopy. Techniques such as air-assist, droplet size reduction, and electrostatic charging of droplets have all been implemented with varying levels of success. Most promising, so far, is the use of air assisted electrostatic sprayers which operate under low air and liquid pressures and impart a consistently high charge to mass level to the droplets of the uniform spray cloud produced.

Though there have been advances in spray coating technology, several unique circumstances have emerged over the past decade in the fields of agriculture, food safety and public health which demand further enhancements and modifications of current art sprayers to meet the challenges. These novel circumstances bring into play factors which range widely across environmental, economic, political and financial considerations and further impact the nature of how spraying systems are designed.

Agricultural production around the world is trending toward high density plantings to meet growing global population food needs and reduce farm inputs maximize the carrying capacity of the available arable land. High density cultivation with its multiple conservation benefits as well as allowing for higher yields in a smaller area creates challenges for traditional industrial farming implements due to narrow drive rows and dense plant canopies that can be difficult to penetrate with agricultural chemical sprays (Connelly, et al., 2000; Rigg, 1997). Another trend that is seeing a marked increase is the movement of food production indoors or into covered structures. These high density, protected environmental growing conditions hedge against climate instability and extend the production seasons as well as conserving resources such as water and fertilizers. Many of these commercial covered food production systems are even showing up in and near cities and even on building roofs. Again, this poses logistical and cultural challenges for traditional industrial agricultural equipment. Large, loud, heavy diesel tractors blow exhaust and pose chemical drift or runoff hazards which would be unacceptable in such environs. The size and relative lack of maneuverability of such equipment would also be limited within the confines of covered, high-density agriculture.

Just as the manner and locations in which plants and animals are grown for food have changed, so have the chemical inputs to sustain high production levels. Environmental regulations are increasingly reducing the number and type of agrochemical inputs available. Many chemicals are now significantly more expensive than in the recent past. Pest resistances to what chemicals remain further reduce a producer's chemical toolkit. Organic inputs have risen in popularity for their perceived reduced negative impacts on human health and the environment. Since organic products chiefly work only by direct contact with a pest, thorough and even coverage is essential for cost effective control.

An extremely active area of growth in the field of agricultural management is the development and use of biological and biologically-based pesticides known as biorationals. Significant driving forces behind the rising interest include recent regulatory initiatives to deregister numerous chemical pesticides within the next 10 years in many countries. Increasing concern with pesticide residues in food and public spaces has also contributed (Hynes 2006).

Biorational pesticides and biopesticides are derived from a variety of biological sources, including bacteria, viruses, fungi, nematodes and protozoa, as well as chemical analogues of naturally occurring biochemicals such as pheromones and insect growth regulators (IGRs). Applications of live nematodes and insect eggs as biological control methods are also increasing in use. Popularity has been rising for these products and methods which pose little or no adverse environmental or human health effects when used as pest control solutions. Due to a multitude of regulatory factors biorational pesticides are likely to become important factors in agricultural pest management. (Brandenburg, 1999; Guillebeau, 1998)

Many, so called, biorational control products are widely and commercially available. Due to the delicate nature of the organisms, the expense of producing the formulated products, and the need for highly accurate placement of the spray, particular consideration must be given to efficiently and properly apply them. Damaging or otherwise rendering the product or organism non-viable during the application process is of primary concern. It is widely agreed that effective application technologies are required which take into consideration the unique limitations and application parameters of biorational products (Gan-Mor, 2003). Limitations in availability of effective spray application technology currently slow widespread adoption as existing spray technologies are inappropriate in many instances. Handling considerations for biological and biorationals include volume, agitation, pressure and recycling time, system environmental conditions and spray nozzle shear forces, rates and distribution patterns. Research which describes the negative impacts of traditional spray equipment on some of these products is described below.

Beneficial nematodes: Nematode viability has been shown to be negatively impacted by sprayers which pump at pressures greater than 200 kPa. Long pumping periods in high pressure sprayer systems also decreased nematode viability due to the rise in temperature in the liquid after multiple passes through the pump as well as mechanical stresses from piston pumps and the nozzle (Nilsson and Gripwall, 1999). Hydrodynamic damage from fan nozzles is known to damage entomopathogenic nematodes (Fife et al. 2003, 2005). Though three common pumps (centrifugal, diaphragm and roller), when tested, showed no mechanical damage to nematodes after a single passage through each pump at operating pressures up to 828 kPa (120 psi), repeated passages through the pump, such as would be likely for high volume sprayers running at high pressures, caused significant mortality as a result of liquid temperature increases (Klein and Georgis, 1992). Improved control of dosing and delivery to the target site has also been noted as a critical factor for successful use of beneficial nematodes (Shapiro-Ilan, 2006).

Biopesticides: Few biopesticides are currently used commercially as alternatives to chemical pesticides. Part of the problem is due to the lack effective application technologies available to farmers. The success of using existing spray technologies has been very limited due to the inappropriateness of the equipment and complex formulations that would help biopesticides successfully withstand the spraying process. High pressure recirculating pumps have been shown to damage cells and reduce viability. Due to the expense of biopesticides, wastage needs to be minimized. Proper control of droplet spectrum and target deposition specificity also factor greatly into effective utilization of these environmentally benign control products. Non-spore forming bacteria, fungi and viruses are the next generation of pest control products that will lead to improved crop productivity, but also have increased sensitivity to the forces inherent in the spraying process (Hynes 2006). Cells in these formulations are unlikely to perform well in systems with operating pressures higher than 200 MPa or systems with large shear or hydrodynamic forces (Malone, 2002).

Electrostatic spraying equipment employing air-assistance and that can apply the materials with high uniformity and meet delicacy demands of the products is seen as the most promising method of delivery (Gan-Mor, 2003). Research has shown that a sprayer meeting these conditions provided better control when applying a bacterial agent than a standard spray methodology due to the high mass transfer and concentrated nature of the low volume application (Perez et al., 1995).

Perhaps the most widely recognized facet of the rapidly changing world agricultural system is the recent significant decline in honeybee populations. This situation which threatens world food security has given rise to an urgent need for alternative methods of pollinating crops that is cost effective. Artificial pollination using mechanical methods and hand labor currently exist and have been used to a small degree over the years. Proper implementation of these methodologies can lead to significant yield and quality increases. However, high costs and complex, specialized techniques for gathering, storing and applying pollen have limited the use of this practice to only very high value crops (Zhang, 2011; Gan-Mor, 2009, Yi, 2003). Current precision application techniques which consume minimal amounts of the expensive pollen are often extremely labor intensive. Electrostatic application of pollen has shown exceptional promise due to low pollen use and high mass transfer efficiencies (Gan-Mor, 2009; Yi, 2006; George, 2006). However, sufficient particle charges and air velocity are critical factors in successful and economically feasible implementation (Gan-Mor, 2003; Gan-Mor, 2009). The equipment must also be designed such that it does not damage the pollen during application.

Once food is produced, whether it is in the form of leafy greens or meat, there are yet many more points in the journey from field to table that require highly efficient and evolved spray coating technologies. The Food Safety Modernization Act signed into law in 2011 shifted the burden of food safety from the standard of 'post-incident response' to the active prevention of food safety hazards and events by producers, packers, shippers and sellers. Recent cases in which food packers and producers have been heavily fined or, in some instances, jailed have driven the need for better, yet still cost effective application technologies and chemicals, some of which can be quite expensive. Bio-rational controls, similar in nature to the ones described above are also under consideration. The ideal system would apply a light, even coating to all surfaces of the target with a high efficiency of mass transfer to minimize waste and maximize protection. Induction charging, air assisted electrostatic application equipment has shown in multiple independent studies and in multiple commodities to perform the needed control in a cost effective manner (Law, 2001).

Public health, aside from food safety scares, is another area that demands improved spray coating equipment and methods. Hospital disinfection and sanitization, prevention of disease transmission in high public use areas as well as the need for bio-terrorism remediation methods, just to name a few, are situations where performance above what is available from standard art hydraulic spraying equipment could provide significant benefits. Again, these are scenarios that require thorough, even and efficient coverage with proper chemicals to prevent or remediate disease causing organisms in a quick response fashion. Hospital Acquired Infections claim millions of lives and even more millions of dollars per year. Many if not most of these HAI's are preventable with proper sanitation.

Research was performed in 2013 at an assisted care facility in VA using a high efficiency, air-assisted electrostatic sprayer to spray disinfectants to patients rooms three times per week. Results showed that this method, when compared to standard cleaning methods, saved significant time, material and labor and left 'high touch' areas with far fewer bacteria (http://pacificcrestpa.com/wp-content/uploads/2013/07/Clinical-Trial-Outcomes-MFA-6-12-13-copy.pdf). This method of sanitizing also was able to control a difficult *C. difficile* outbreak in the facility (http://www.haisolutionsllc.com/images/pdfs/steriplex-sd-testimony.pdf). As global travel and population interactions continue to increase, epidemics of communicable diseases such as Avian and Swine flu, SARS or MERS as well as influenzas will become more common and will require rapid response to contain the spread.

At the current time there is no one piece of equipment that could serve the many and varied needs, specifications and requirements of all of the potential spray coating applications and scenarios described above. Therefore, there is a need in the art for a method and apparatus for the highly effective and efficient spray application of liquid suspensions containing delicate microscopic particles such as biorationals, pollen or, as-yet-to-be-developed, specialized nano-materials to three dimensional surfaces in addition to traditionally sprayed materials. Additional requirements of such apparatus are a relatively small size and weight factor but with sufficient power to provide the requisite aerodynamic and electrical forces for maximum liquid mass transfer and surface coverage.

BRIEF SUMMARY

An embodiment of the present invention includes an induction electrostatic spray apparatus may include a liquid supply operably coupled to a gasoline or diesel fuel engine power supply and to a plurality of induction charging electrostatic nozzles, a gas supercharger operably coupled to the power supply, wherein the gas supercharger supplies air to the plurality of induction charging electrostatic nozzles; wherein the liquid supply, the gas supply, the power supply and the plurality of nozzles are configured to deliver an electrostatically charged spray to a locus where the spray is needed and wherein the entirety of the apparatus is mounted on a vehicle selected from the group consisting of a cart, a skid, a rail car, a wagon, an all-terrain-vehicle, and a riding lawn mower.

In another embodiment, an induction electrostatic spray apparatus may include a battery sufficient to supply from 10-20 Amperes of direct current during an operating time of from 1-5 hours, a liquid supply operably coupled to the battery, a gas blower operably coupled to the battery, wherein the liquid supply and the gas blower supply gas and liquid, respectively, to an induction charging electrostatic nozzle; and wherein the apparatus is configured to be mounted in or on a backpack.

DETAILED DESCRIPTION OF EMBODIMENTS OF THE INVENTION

Figure 1:
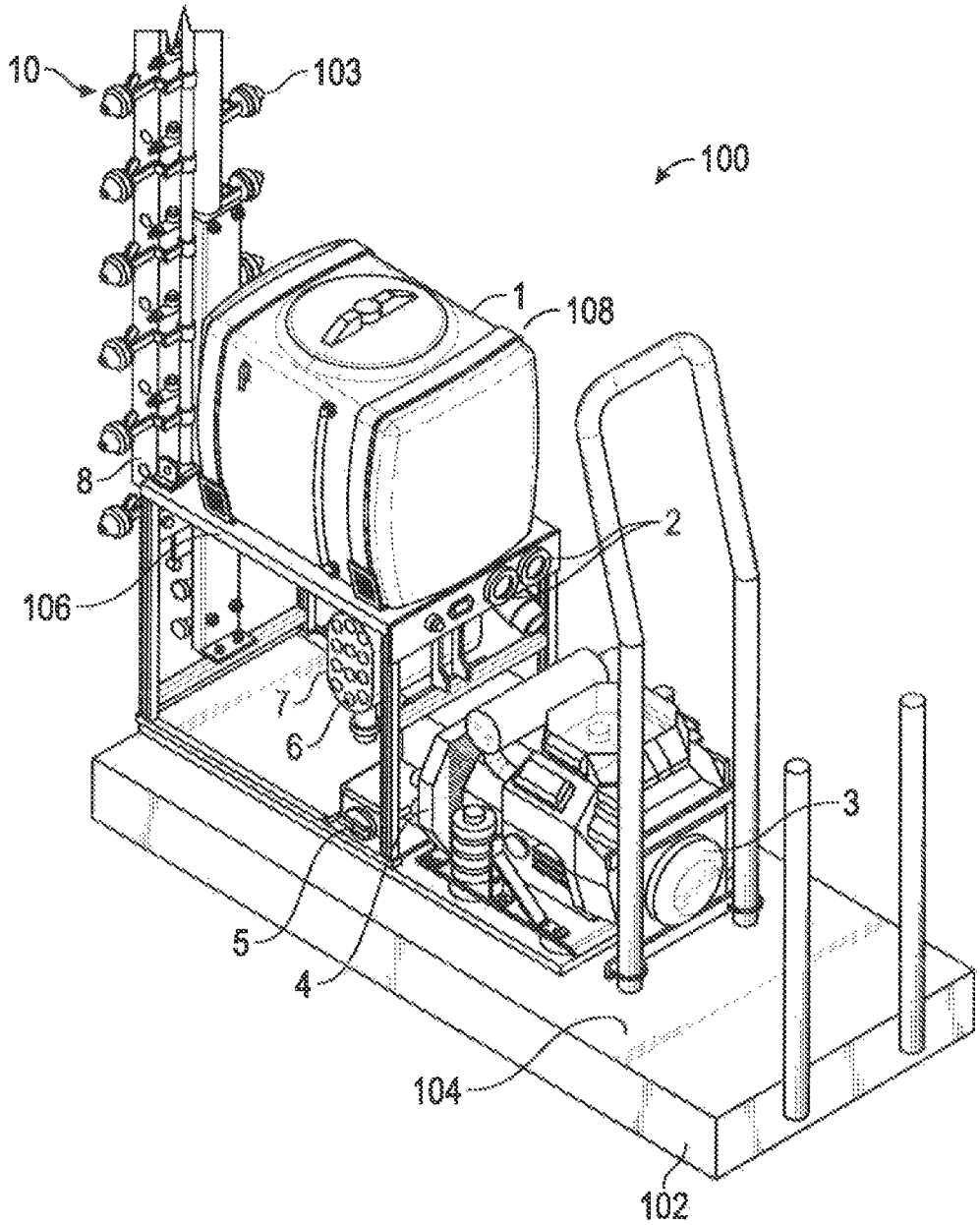
FIG. 1 is a perspective view of an apparatus on a skid according to the disclosure.
Figure 2:
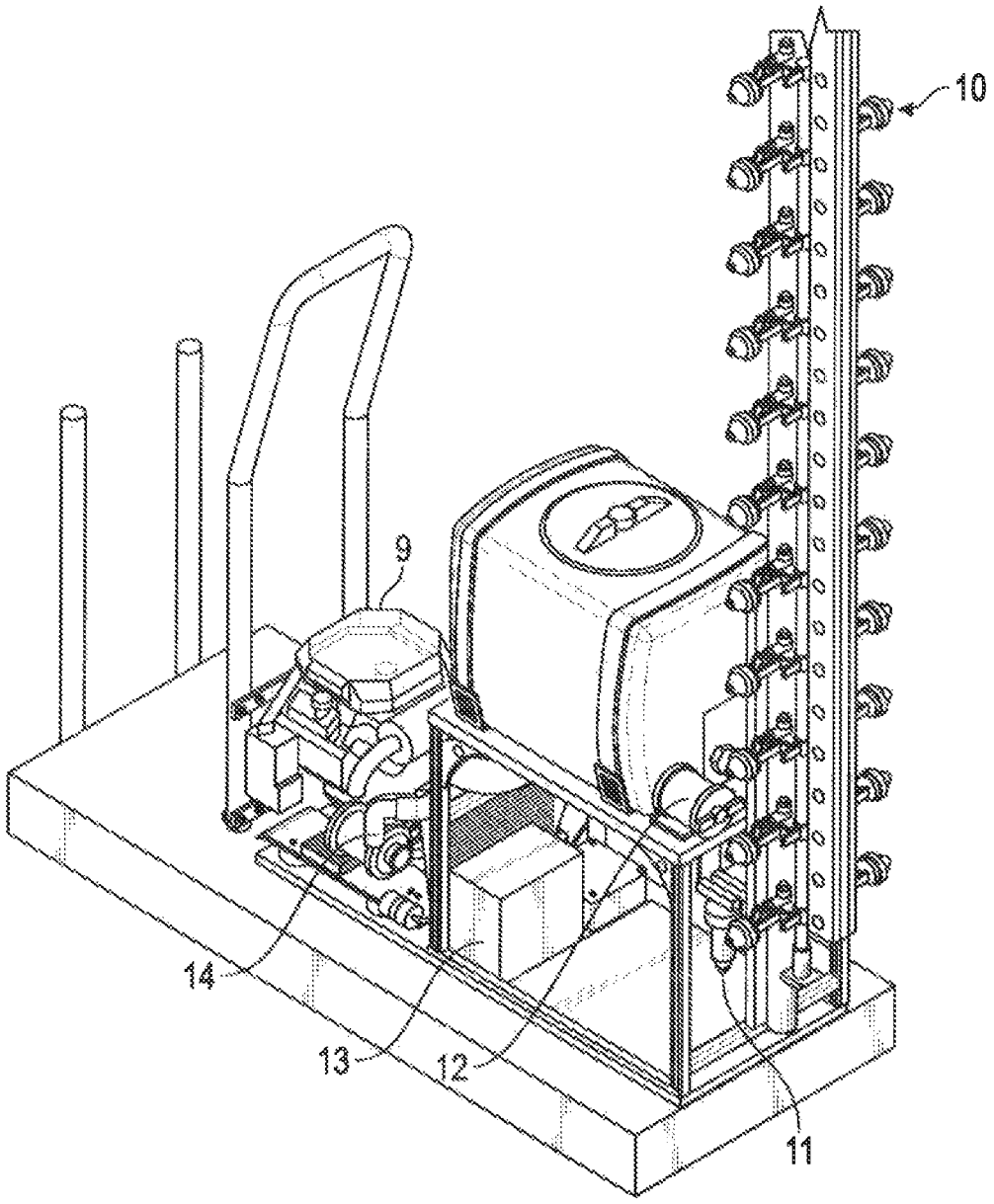
FIG. 2 is a perspective view of the apparatus of FIG. 1 from a reversed angle.
Figure 3:
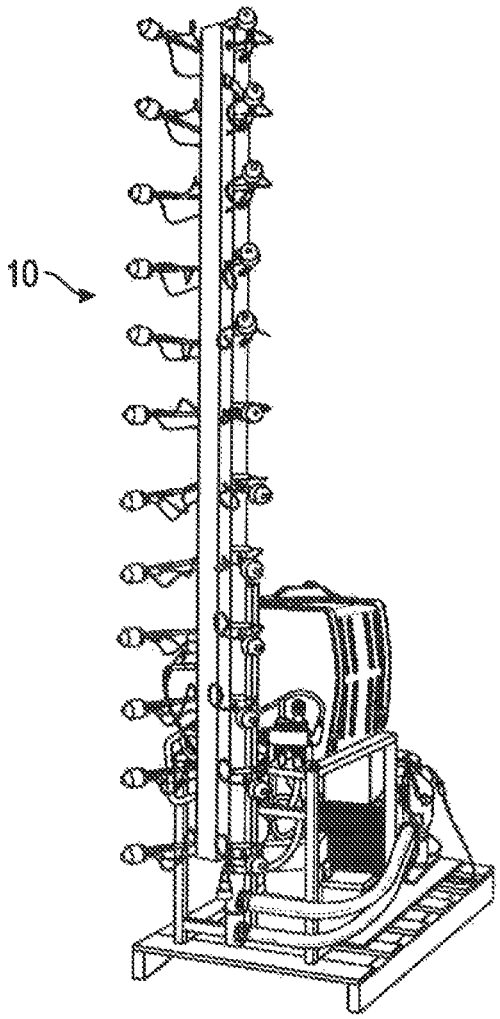
FIG. 3 is a perspective view of a boom, tank and engine of the disclosure.
Figure 4:
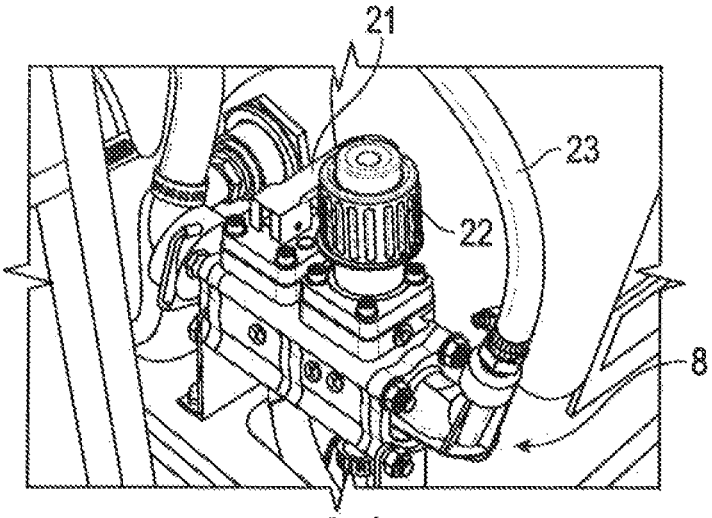
FIG. 4 is a magnified view of a portion of the apparatus of FIG. 3.
Figure 5:
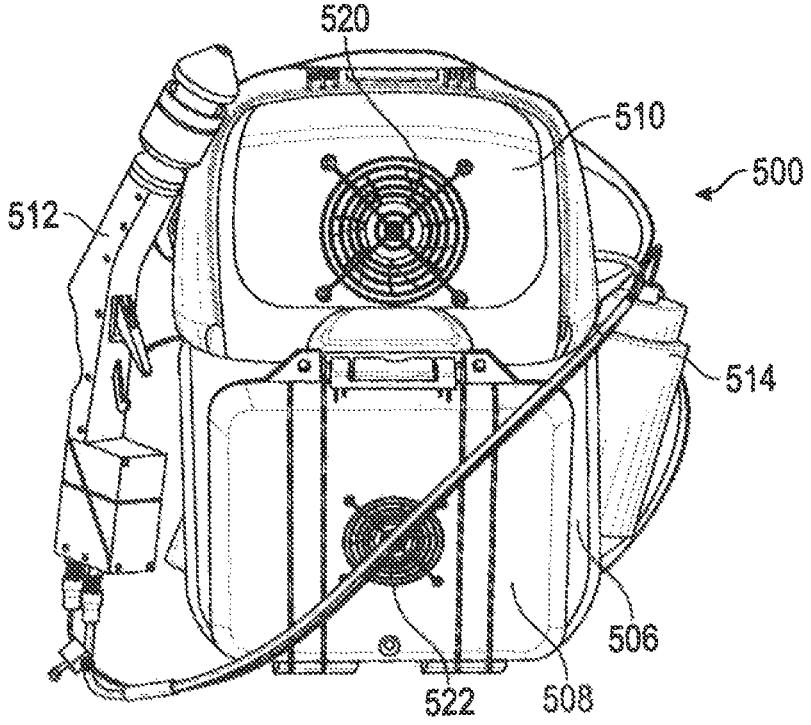
FIG. 5 is a front perspective view of a backpack sprayer according to the disclosure.
Figure 6:
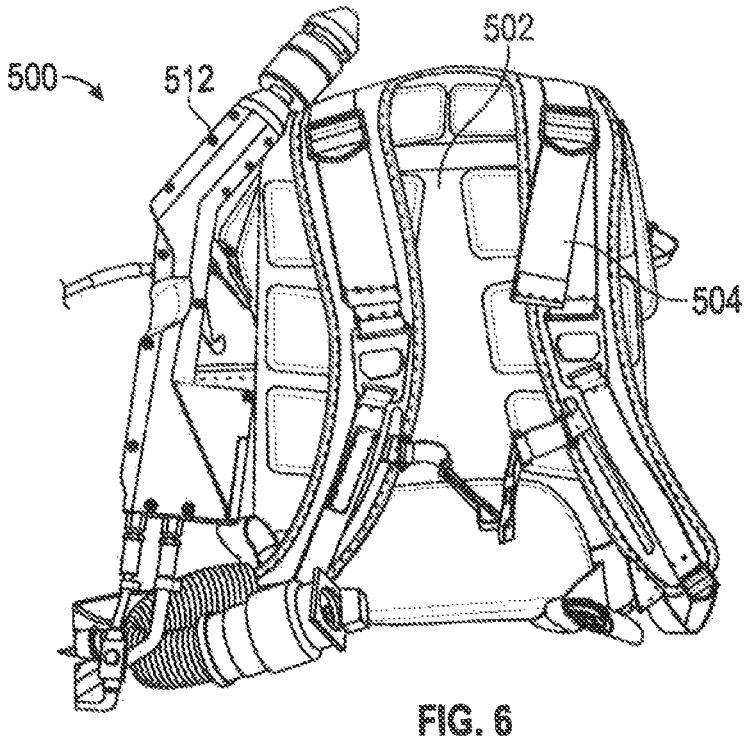
FIG. 6 is a back perspective view of a backpack sprayer according to the disclosure.
Figure 7:
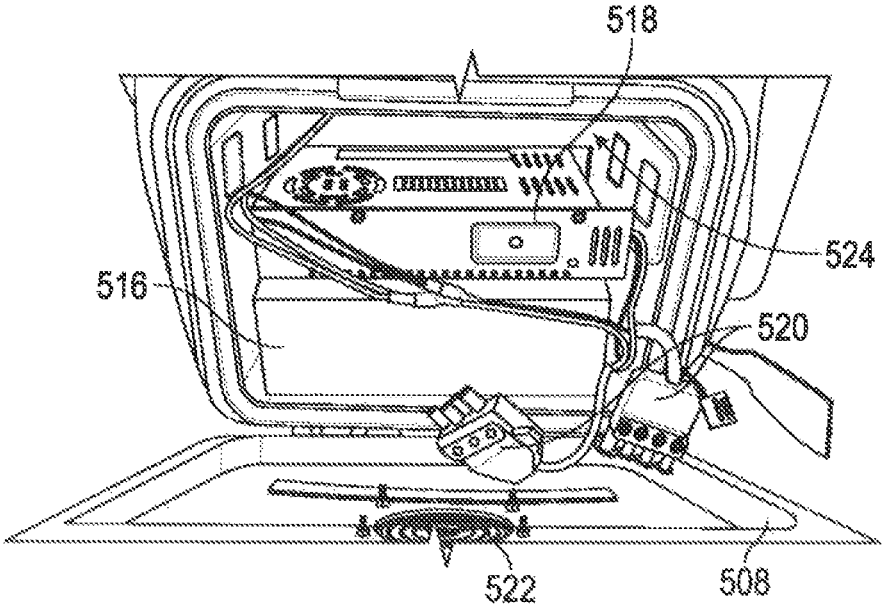
FIG. 7 is a perspective view inside a compartment of the backpack sprayer of FIG. 5 and FIG. 6.
Figure 8:
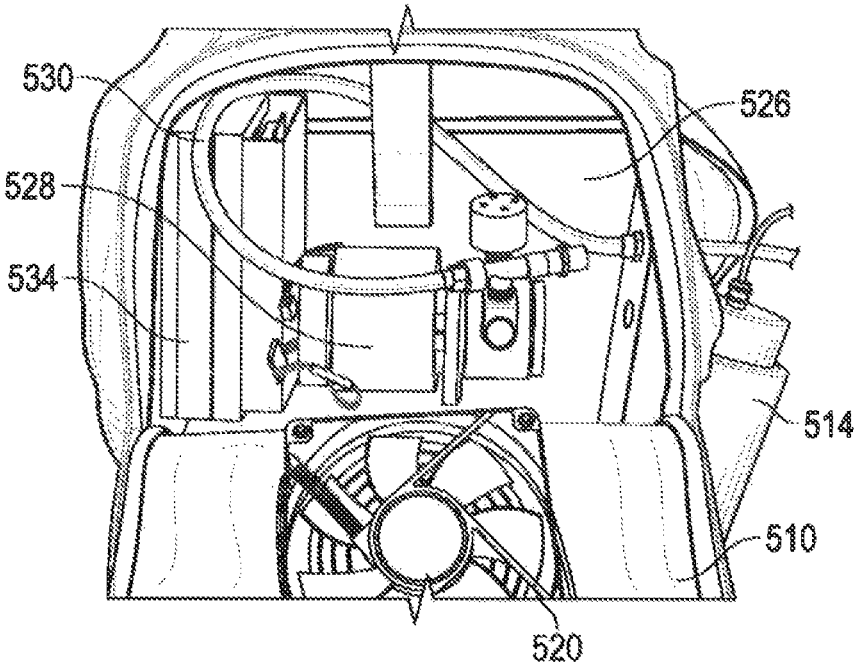
FIG. 8 is a perspective view inside a second compartment of the backpack sprayer of FIG. 5 and FIG. 6.
Figure 9:
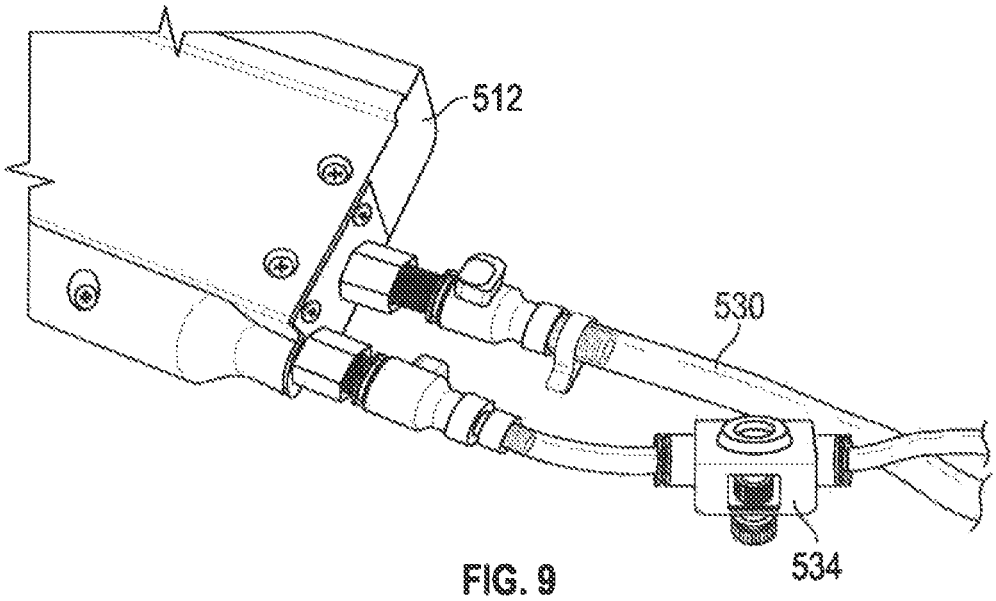
FIG. 9 is a perspective view of hoses linking the backpack of FIG. 5 to an electrostatic spray assembly.
Figure 10:
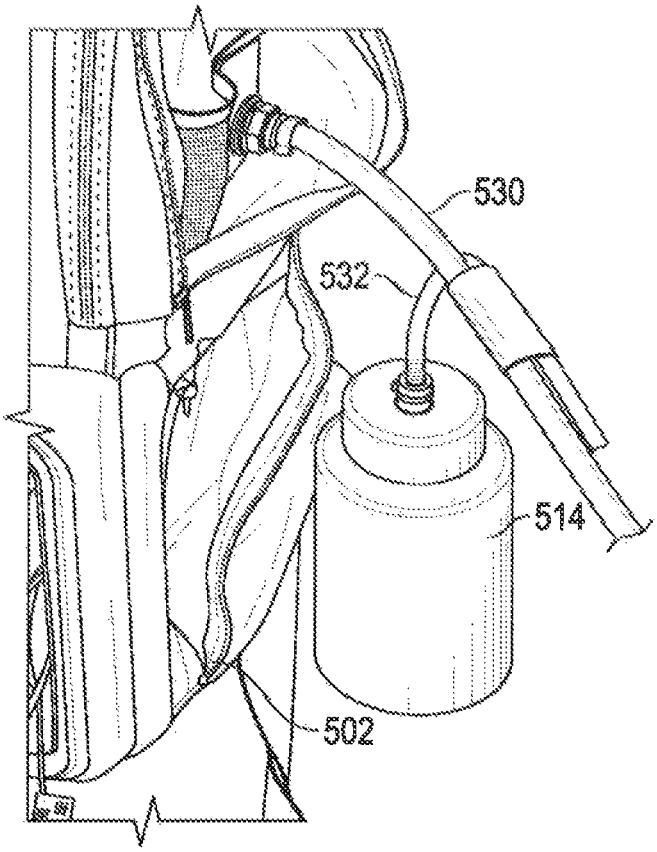
FIG. 10 is a perspective view of a portion of the backpack of FIG. 5.
Figure 11A:
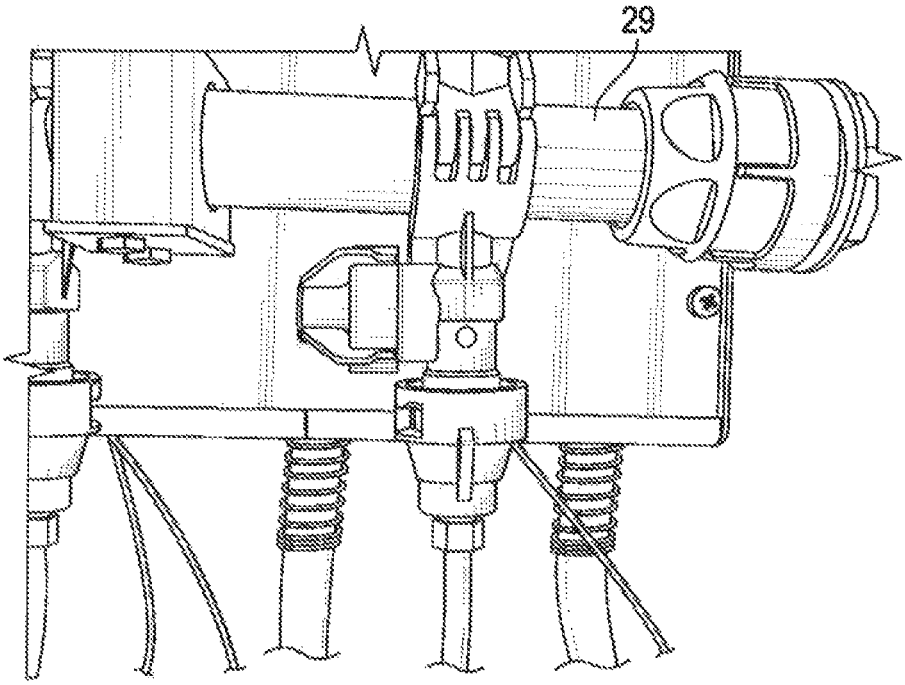
FIG. 11A is an elevation view of a dripless valve assembly according to the disclosure.
Figure 11B:
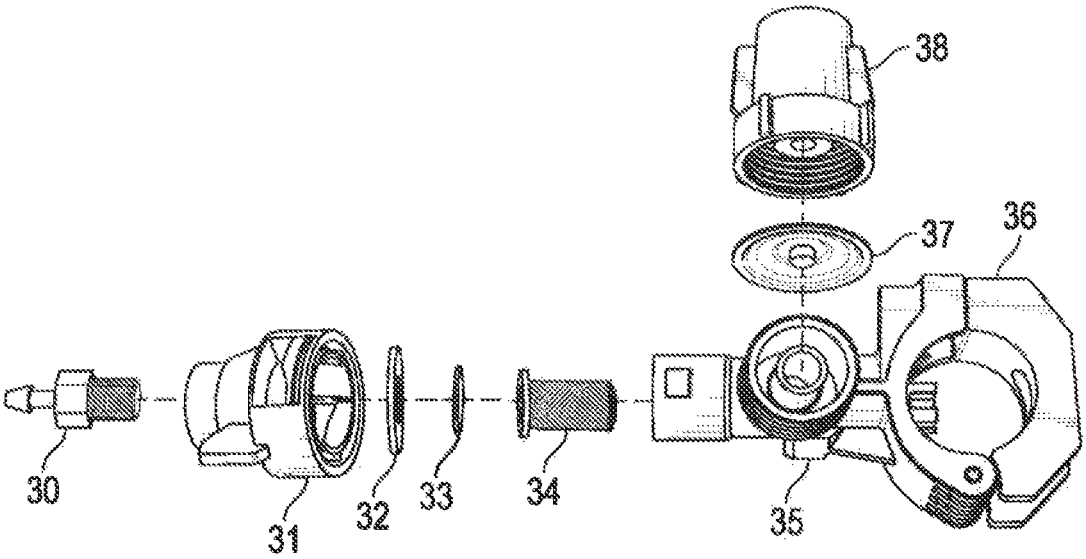
FIG. 11B is an exploded view of the dripless valve assembly of FIG. 11A.

The present invention, as well as features and aspects thereof, is directed towards providing In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

In this application the words "unit" and "module" are used interchangeably. Anything designated as a unit or module may be a stand-alone unit or a specialized module. A unit or a module may be modular or have modular aspects allowing it to be easily removed and replaced with another similar unit or module. Each unit or module may be any one of, or any combination of, software, hardware, and/or firmware.

To provide a method and apparatus which address the widespread need for powerful yet small form factor, e.g., physical footprint, high efficiency sprayers which have the added capability of effectively and efficiently applying delicate microscopic particles with minimal damage sustained by said particles. By operating as a self-contained, low volume sprayer the apparatus can be rapidly and easily deployed for use as well as saving time, labor and material costs. In an embodiment, the apparatus may be mounted on a platform, of from about 6 square feet to about 9 square feet. By the term platform is meant cart, skid, rail car, wagon, all-terrain vehicle, riding lawn mower, pallet, utility vehicle, pickup truck, and trailer.

The compact size and efficient nature of a supercharged air supply and high mass transfer efficiency attributed to ultra-low volume, induction-charging, electrostatic spraying nozzles minimize both waste and equipment size without sacrificing the powerful spraying capacity of a larger or heavier form factor unit. Specifically controlled, low force conditions maintained within the liquid, gas, mechanical and electrical components of such spraying apparatuses and methods additionally provide a means for the advantageous, economical application of delicate particulates such as biorational pesticides.

In preferred embodiments the sprayer apparatus consists of four main integrated components: 1) a low pressure liquid supply, 2) a low pressure, high volume gas supply, 3) a power supply, and 4) one or a plurality of atomizing, induction charging electrostatic nozzles. These main components are then contained on and supported by an electrically grounded, narrow, small size factor frame or platform such that the entire apparatus is self-contained and easily portable and maneuverable.

In further preferred embodiments, the liquid supply system consists of a tank, pump, agitation system, piping, filters, flow control assembly and pressure indicator and is powered by an onboard engine; e.g., a gasoline and/or diesel combustion and/or liquid propane engine. The air/gas supply system consists of piping, wiring, filters, a compact, high-efficiency supercharger, a gear multiplier, a small engine e.g., the onboard engine, with sufficient power to run the supercharger, oil and compressed gas cooling mechanisms and a pressure indicator; the electric power supply system consists of wiring, switches, an alternator powered by the engine, a battery, a power indicator light and one or a plurality of voltage power regulators. In yet another aspect of the preferred embodiment, there may be one or a plurality of atomizing, induction charging, electrostatic nozzles to which the other systems respectively supply electrical current, low volume conductive liquid and high volume gas (typically air) under low pressure. All operational considerations of the systems forming the basis of the current disclosure operate under minimally damaging conditions for the spraying of aqueous suspensions of microscopic delicate particulates as well as a wide range of other conductive liquids.

In an embodiment several factors contribute to the relatively low weight and small size of the apparatus. Individual electrostatic nozzles and liquid hoses are materially designed for maximum energy transference to atomized droplets and minimum current loss to the outside of the nozzles or via the equipment body. The result, therefore, keeps amperage draw needs as small as possible. Efficient energy transfer and low energy losses conserve engine power requirements and thusly help keep engine size low. Another aspect of this embodiment contributing to the small form factor is the sprayer's inherent ultra-low volume liquid application rate. Because the liquid output of the present invention is small and mass transfer to target is high, liquid tank size can be minimized without causing an increase in the number of resource consuming tank filling operations required. Smaller liquid tanks reduce overall sprayer size as well as equipment weight, particularly when the tank is filled. Yet a third size factor reducing embodiment employs the use of a high efficiency blower in the form of a compact supercharger which provides powerful aerodynamic forces, but require much less engine power, are lighter and take up far less space than would be needed by a typical blower providing equivalent air volumes under similar pressures.

Additionally, multiple operational factors contribute to minimally damaging and highly efficient applications of delicate microscopic, liquid suspended particles. Pressures in both the liquid and gas systems remain below harmful levels for the materials being sprayed. The atomization process employs a method that provides a consistent, small droplet size without employing excessive mechanical or pneumatic forces. Also, electrical fields in the inducting charging nozzles are maintained at a level to sufficiently electrostatically charge atomized material via induction but not strong enough to irrevocably disrupt particle structures or their ultimate viability.

With reference to FIG. 1, FIG. 2, FIG. 3, and FIG. 4, a small size form factor, self-contained electrostatic spraying system 100 is mounted on a skid 102. A sprayer having a single vertical boom assembly 10 comprises a liquid distribution manifold, air manifold, an enclosed wire way is mounted with a plurality of ultra low volume, air assisted, induction charging nozzles 103. In this particular embodiment, space 104 has been allotted on the skid 102 for the inclusion of a separate engine for a cart drive system to be employed in an enclosed environment, e.g., narrow row greenhouse environment, or at a locus generally inaccessible to a motorized vehicle such as a tractor. In alternate embodiments the skid may be augmented with a transport mechanism e.g., with wheels, and/or a conveyance mechanism, e.g., an onboard conveyance mechanism. In an embodiment, the system 100 may be mounted on a floatation device, e.g., a boat, for aqueous applications, e.g., a flooded rice field.

The electrostatic spray apparatus includes a liquid system assembly. In an embodiment a 30 gallon (113 liter) polyethylene liquid reservoir 1 is affixed to a chassis 106 e.g., with straps and contains a liquid strainer (not shown) that fits into the top opening for separating large particles from the spray liquid as it is poured into the reservoir 1. As the liquid pump 12 runs, a recirculating hydraulic agitator mixes liquid in the tank to prevent settling out of particulates and minimizes product separation.

The electric centrifugal liquid pump 12 is connected to the tank by a feed line containing a liquid strainer 11. The liquid pump further creates a relatively low pressure, e.g., about 20-40 psi, or approximately 30 psi to various pipes. One pipe provides a pressure reading to the liquid filled liquid pressure gauge 2. A separate dielectric liquid inlet hose 23 enters a liquid regulator assembly. The liquid regulator assembly consists of a manually controlled lever 21 for switching on the liquid to the boom, a proportional control valve 22 which can be adjusted to modulate the tank agitation and liquid pressure. Liquid is then further directed to the liquid manifold, e.g., reservoir, on the boom assembly 10. Further embodiments of the liquid system in the present disclosure may include a tank rinse system or closed chemical injection and mixing system. Tank environmental controls which favor conditions for optimal biorational particulate viability, such as heating, cooling or shading may be incorporated. An alternative agitation system to a liquid hydraulic jet may include, e.g., a bubbling system to prevent damage to particularly delicate particulates.

Continuously grounded spray liquid stored in the reservoir 1 is sucked into the line by the pump 12 and transferred to the wet boom portion of the boom assembly 10, passing through an inline liquid strainer 11 en route. Once the liquid in the manifold reaches a predetermined pressure, liquid flows through dielectric tubing to the rear inlet of the nozzle and is discharged through the high efficiency, electrostatic induction charging nozzles and onto the target at a locus. This pressure switch ensures that liquid is cleared out of the lines by the pressurized gas when the liquid flow valve is closed. Electrical arcing is thus avoided and liquid line clogging reduced.

With reference to all figures, a pressure regulated liquid dispensing system ("wet boom") is included on this embodiment. For example, manifold 7 includes conductive and electrically grounded pipe or tube 29. Along the length of the pipe, holes are drilled at regular intervals, one for each nozzle. Each hole in the pipe accommodates a clamped on flow regulating TeeJet nozzle body. The nozzle body contains a check valve assembly 35, 37 which enables passage of liquid through a nipple 30 into a dielectric hose into the back of the electrostatic nozzle 26. The clamp body for each TeeJet single nozzle body (part QJ17560A-NYB from supplier TeeJet) is fitted with a dripless shutoff valve, e.g., a ChemSaver drip-free shutoff valve 38, and pressure rated diaphragm 37 controlling a check valve 35. Once the liquid passes the check valve, it is fed through the nozzle body that optionally contains an inline mesh strainer 34 and flow regulating disc 33. Some benefits of this "wet boom" design include substantially equal liquid pressurization across the manifold wherein: the flow of liquid can be initiated and stopped in a more uniform and prompt fashion than the prior art booms once a set liquid pressure is achieved; a liquid line extends from each nozzle body via a quick coupling 31 containing a flow regulator disc to the back of the spray nozzle; one or more main liquid lines may feed into the center of the wet boom from the liquid pump 12 to provide pressurized liquid that is distributed throughout the boom; and equally sized holes, evenly spaced along the liquid manifold are drilled in the conductive tubing 29 to accommodate the TeeJet nozzle body.

The entire boom assembly in various embodiments may include deflectors as seen in and/or break away hinges to prevent crop branches or other obstructions from pushing the nozzle out of alignment or from breaking the boom assembly.

Nozzles may be attached to the air manifold with any manner of piping, such as swivel fittings, stay in place hose, fixed or other via suitable methods which allow sufficient passage of air while permitting directional placement of nozzle and may be such that each of the spray heads may be independently, directionally rotated about a fixed axis.

Booms may be mounted in one or more configurations, e.g., vertical, horizontal, or in another articulated configuration, as selected. Alternatively, the boom may be replaced with one or more hose reels fitted with one or more spray guns. In alternative embodiments manual or automated boom height adjustment mechanisms may also be incorporated with the apparatus.

The powered system assembly of the present embodiment comprises a fuel tank, gas powered engine 9, muffler, alternator, power storage battery in a protective box 13, voltage multiplying power supplies, air-to-air heat exchanger 4, and a master disconnect switch 5. Electrostatic charge indicator lights may switch on once power is flowing from the battery. In alternate embodiments, the engine may be electric, propane, diesel or some other type provided it produces sufficient power to operate the sprayer. The electrostatic charge indicator lights may be placed in any conspicuous location on the sprayer apparatus.

The onboard air supply system is powered by the engine's crankshaft and is composed of a compact, high-efficiency supercharger. Air is supplied to individual nozzles through an orifice located in the back of the nozzle body 27. Low pressure, high volume gas flow produced is used, in this embodiment, to aerodynamically convey the droplets a significant distance in a turbulent stream to maximize target impingement and entrapment, particularly for complex target geometries.

A representative nozzle that may be used according to the disclosure is found in U.S. Pat. No. 5,765,761, incorporated by reference herein, and relied upon. In this embodiment liquid is pneumatically atomized with the assistance of a supercharged low pressure gas which causes far less mechanical damage to delicate particulates than the mechanical shearing of standard sprayer nozzles. The nozzle is designed to form a cloud of evenly sized droplets of conductive liquid that carry a high charge to mass ratio of greater than 2 mC/kg. This is accomplished through proper consideration of liquid earthing and elimination of stray current pathways. As such, the spray apparatus in this embodiment is capable of consistently producing and charging droplets throughout the spray duration, thereby imposing a strong image charge on target objects and ensuring high mass transfer efficiency and minimum overspray.

Other embodiments of electrostatic induction charging nozzles that could be used on this spray apparatus could produce droplets via alternative methods such as piezo electric, ultrasonic formation, etc. as long as the pressures and forces were not sufficient to compromise the structure or integrity of delicate particulates. The air stream in other embodiments could be used to entrain or shape the spray cloud in addition to providing a conveyance mechanism.

Further embodiments of the spray charging nozzles could include an oscillating or rotating mechanism. Various refinements and precision agriculture components could be included in further embodiments to improve spray efficiency such as GPS, optical target sensors triggering spray stream or remote monitoring and control are among some of the more obvious.

The mechanism and/or apparatus of the present disclosure may be interfaced with a computerized system or module which could enable remote monitoring and/or adjustments.

The current preferred embodiment composed of the systems and components previously described sprays ultra-low volumes of aqueous solutions of electrostatically charged, finely atomized droplets. The unit would be typically pulled, pushed or driven alongside or over the intended spray target(s). Multiple design considerations of the current embodiment ensure a consistently high level of liquid mass transfer efficiency throughout the spray event even when operated for extended periods under adverse weather or field conditions. Design considerations also are integrated to create a small size and weight, self-contained spraying apparatus with some capabilities typically only found on much larger sprayers of the prior and current art, but which still allow for successful application of delicate microscopic particles. The selection of the appropriate materials for construction of the sprayer and it's respective parts will be governed by considerations of chemical and electrical compatibility with the liquid being sprayed and the need for highly conserved electrostatic imparting of charge to the atomized droplets.

In another embodiment, a backpack-mounted, or backpack-configured, spray apparatus may include a battery and electrically powered portable self-contained electrostatic sprayer. Embodiments of the solution may comprise a rechargeable battery pack, an air compressor, an electrostatic spray gun/nozzle, a chemical/disinfectant reservoir and a controller. As would be understood by one of ordinary skill in the art of electrostatic spraying, an electric charge may be applied to an atomized flow of chemical such that charged droplets of the chemical are electrically attracted to surfaces that may harbor pathogens or the like. The electric charge may be supplied by the rechargeable battery pack and/or another source of electrical power, e.g., a small battery.

With reference to FIG. 5, FIG. 6, FIG. 7, and FIG. 8, sprayer 500 includes a backpack structure 502, straps 504, outer shell 506, door 508, upper door 510, electrostatic spray nozzle assembly 512, and liquid reservoir 514. Battery 516 is operably connected to controller 518, both of which are enclosed in compartment 524. Battery 516 supplies power to fans 520 and 522. Wiring and connection system 520 delivers power to the apparatus. Fan 520 provides outside cooling air to compartment 524.

Compartment 526 includes compressor 528 that feeds compressed air through line 530 to the outside of structure 502 and then to nozzle assembly 512. Compressor 528 is mounted in compartment 526 through board 534. Liquid is drawn from reservoir 514 by vacuum, and liquid flow regulated through thumb valve 534 before entering nozzle assembly 512. Liquid and air are admixed in assembly 512 as known in the art, e.g., in U.S. Pat. No. 5,765,761.

The battery 516 may in an embodiment be configured and/or be capable of delivering of from about 10-30 Amperes, or about 20-30 Amperes, or about 10-20 Amperes, of direct current for a period of about 1-6 hours, or about 1-5 hours, or about 1-4 hours, or about 1-3 hours, or about 1-2 hours, or about 2-6 hours, or about 2-5 hours, or about 2-4 hours, or about 2-3 hours or about 3-6 hours, or about 3-5 hours, or about 3-4 hours, or about 4-6 hours, or about 4-5 hours, or about 5-6 hours.

In an embodiment, the battery may be comprise lithium. In an embodiment the battery is a lithium iron phosphate battery, e.g., a 24V 20 Ah LFP battery available from Bioenno Tech, LLC, 12630 Westminster Ave. Suite B, Santa Ana Calif., 92706, USA, or at http://www.bioennopower-.com/products/24v-20ah-lfp-battery-black-pvc-pack-charger?variant=1012041156.

It is envisioned that certain embodiments may be contained in a backpack form easily worn and transported by a user. In an alternative embodiment, the backpack may be contained within a roll-behind suitcase-like form that a user may be pulled along.

Advantageously, embodiments of the solution do not require hoses and electrical cords outside of the self-contained form, thereby eliminating the need to be tethered remotely to stationary power and compressed air sources. Although embodiments of the solution are self-contained, it is further envisioned that some embodiments may also be configured for tethering to a remote and stationary power (e.g. a house battery or a structure battery) and/or compressed air source.

Figure 12B:
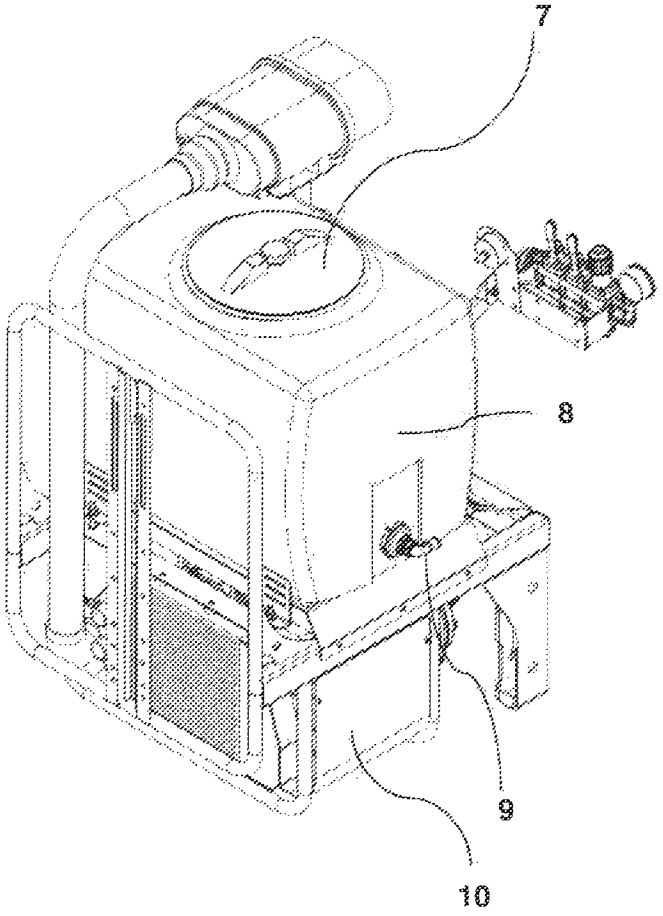
FIG. 12B is a reverse perspective view of the apparatus of FIG. 12A.
Figure 12A:
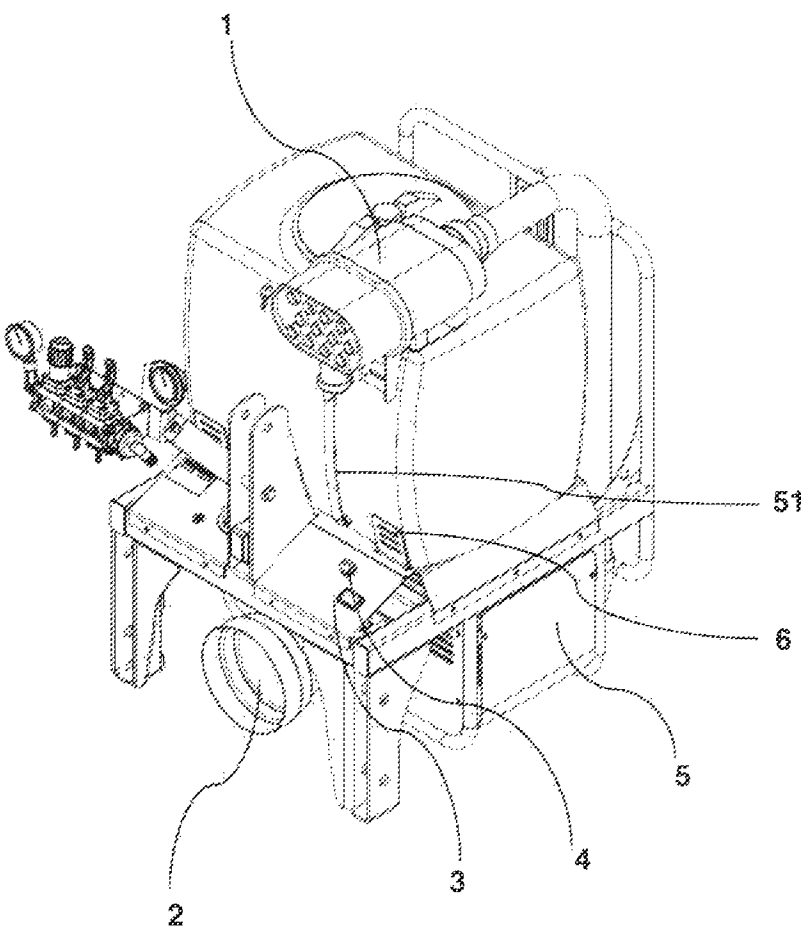
FIG. 12A is a perspective view of an apparatus according the disclosure.
Figure 13B:
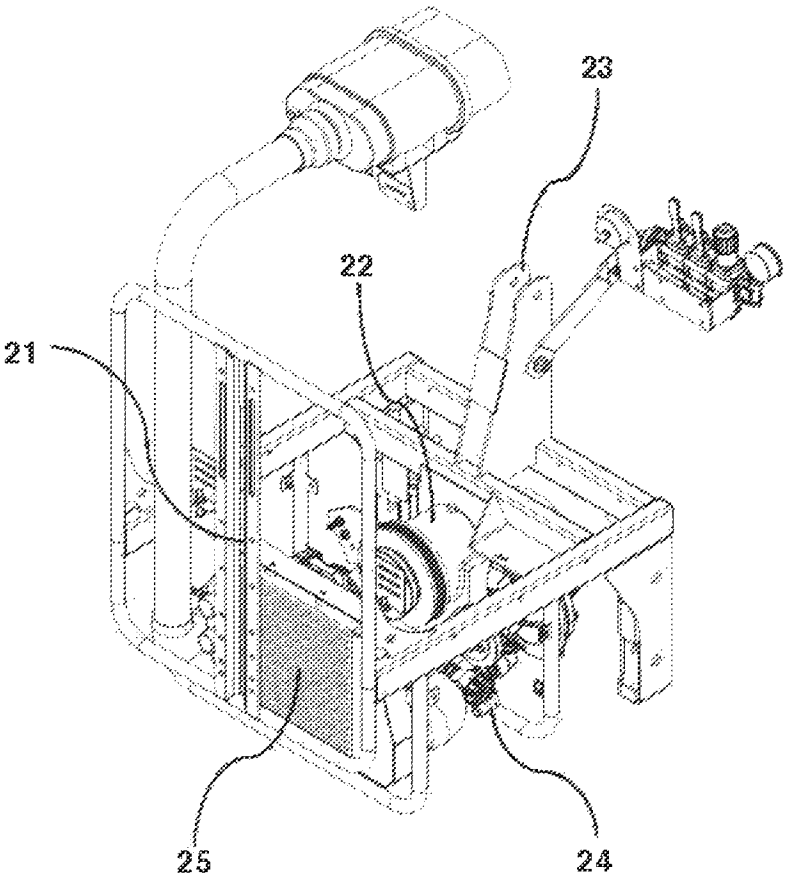
FIG. 13B is a perspective view of the apparatus of FIG. 12B with reservoir 8 removed.
Figure 13A:
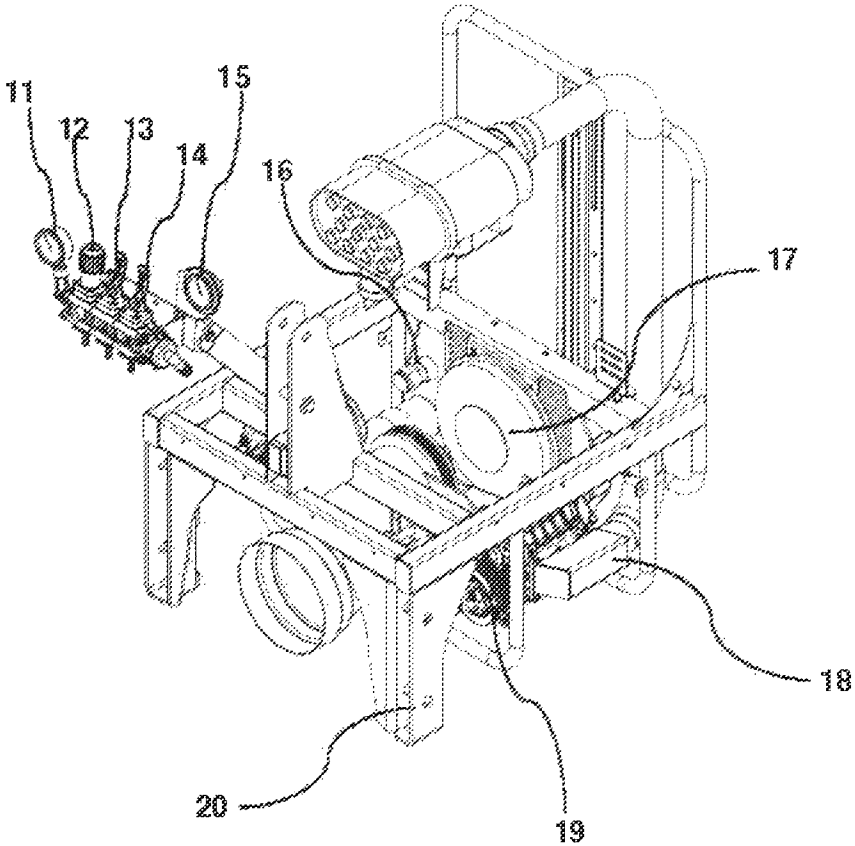
FIG. 13A is a perspective view of the apparatus of FIG. 12A with reservoir 8 removed.

In another embodiment, and with respect to FIGS. 12A and 12B: FIG. 12A shows a front right perspective view and FIG. 12B a rear right perspective view of a spray apparatus, minus spray booms, in an embodiment of the present invention. The spray apparatus also encompasses a small size form factor and mechanism for supplying a low volume of liquid but high volume of low pressure air to a single or to a plurality of spray booms.

Figure 14:
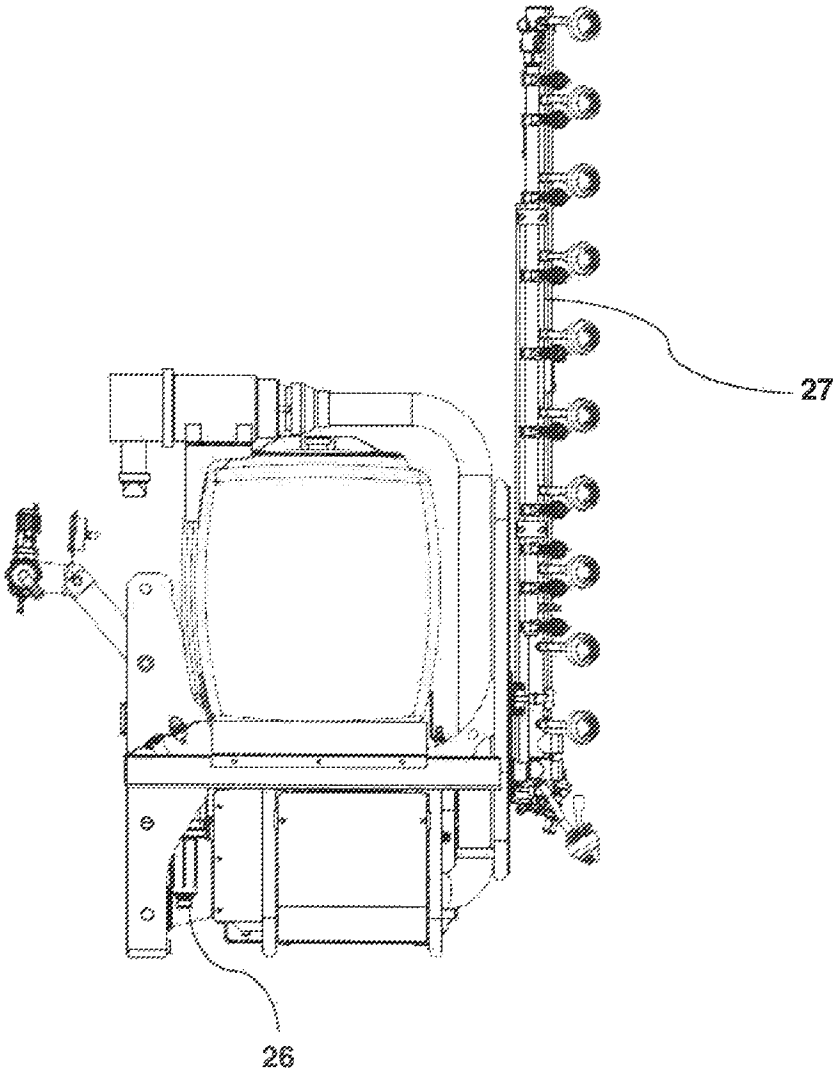
FIG. 14 is a side elevation view of the apparatus of FIG. 12A with a wet boom attached to the frame holding the apparatus.
Figure 15B:
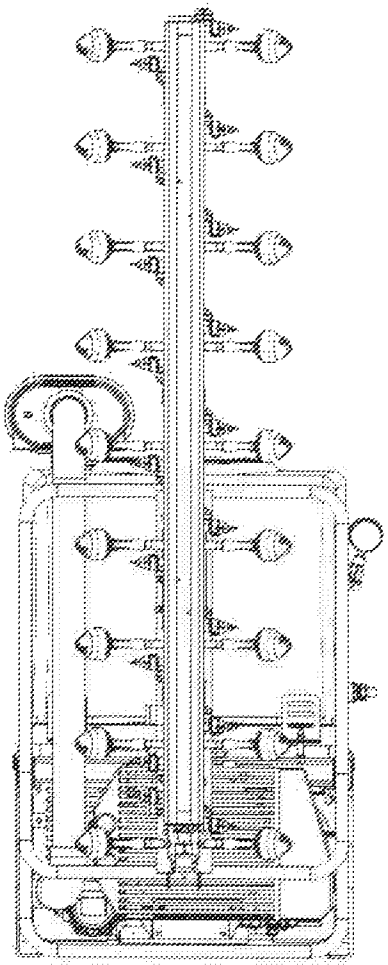
FIG. 15B is a front perspective view of the apparatus of FIG. 12A with a vertical wet boom attached to the frame on holding the apparatus.
Figure 15A:
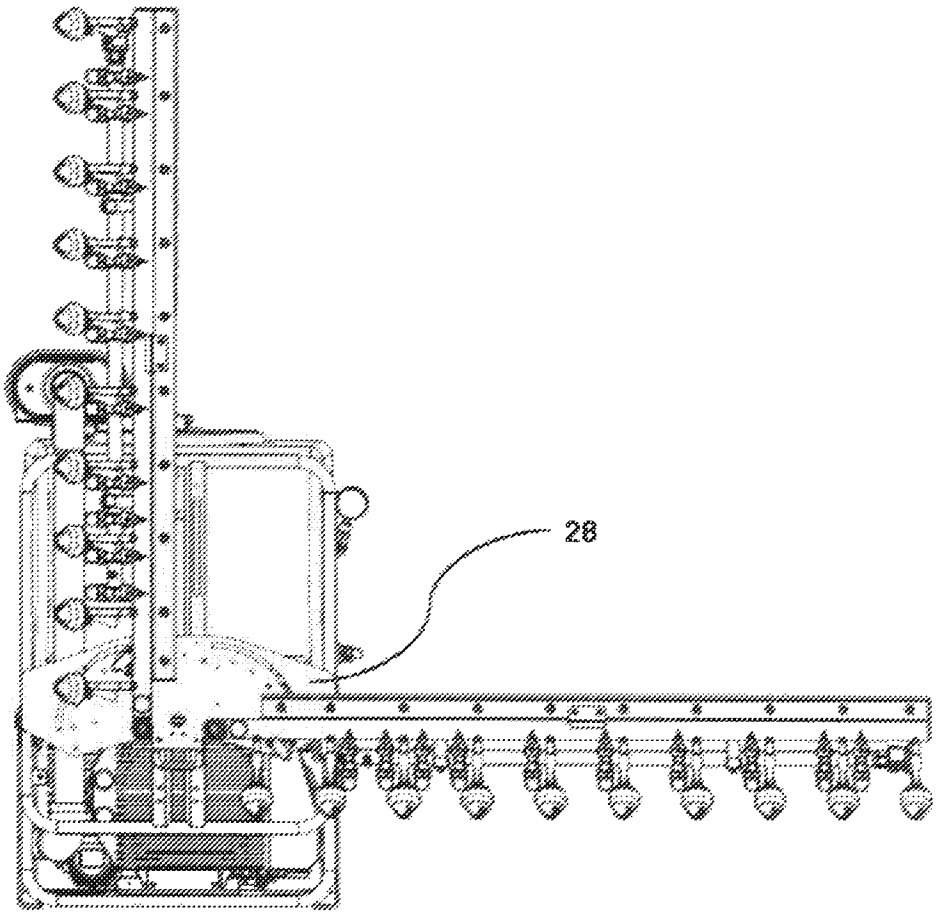
FIG. 15A is a front perspective view of the apparatus of FIG. 12A with two articulable wet booms attached to the frame holding the apparatus.

With respect to FIG. 14, FIG. 15A and FIG. 15 B, a sprayer having a single vertical boom assembly or double, angle adjustable boom assembly including a liquid distribution manifold, air manifold, an enclosed wire way and mounted with a plurality of low volume, air assisted, induction charging nozzles is shown. The electrostatic spray apparatus includes a liquid system assembly. In an embodiment a 30 gallon (113 liter) polyethylene liquid reservoir 8 is affixed to the chassis with straps 6 and contains a liquid strainer which fits into the top opening for separating large particles from the spray liquid as it is poured into the tank 7. As the liquid pump runs, a recirculating hydraulic agitator 9 mixes liquid in the tank to prevent settling out of particulates and to minimize product separation.

The electric centrifugal liquid pump is connected to the tank by a feed line containing a liquid strainer 26. The pump conducts liquid at a relatively low pressure of approximately 20-40 psi, e.g., 30 psi, to various pipes. One pipe provides a pressure reading to the oil filled liquid pressure gauge 11. A separate dielectric liquid inlet hose enters the liquid regulator assembly. The liquid regulator assembly consists of manually controlled levers 13 and 14 for switching on the liquid to the boom and a proportional control valve 12 which can be adjusted to modulate the tank agitation and liquid pressure. Liquid is then further directed to the liquid manifold on the boom assembly 27.

Further embodiments of the liquid system in the present disclosure could include a tank rinse system or closed chemical injection and mixing system. Tank environmental controls which favor conditions for optimal biorational particulate viability, such as heating, cooling or shading could be incorporated. The liquid hydraulic jet could be replaced with a bubbling system to prevent damage to particularly delicate particulates. Continuously grounded spray liquid stored in the reservoir 8 is pulled into the line by the pump and transferred to the wet boom portion of the boom assembly 27, passing through an in line liquid strainer 26 en route. Once the liquid in the manifold reaches a predetermined pressure, liquid flows through dielectric tubing to the rear inlet of the nozzle and is discharged through high efficiency, electrostatic induction charging nozzles. The pressure sensitive liquid flow switch ensures that liquid is cleared out of the lines by the pressurized gas when the liquid flow valve is closed. Electrical arcing is, thus, avoided and liquid line clogging reduced.

The herein described "wet boom" apparatus may be used in this alternative embodiment. The liquid flow control mechanism may be used in this alternative embodiment.

In any embodiment, nozzles may be attached to the air manifold with any manner of piping, such as swivel fittings, stay in place hose, fixed pipe or via other suitable methods which allow sufficient passage of air while permitting directional placement of nozzle and may be such that each of the spray heads may be independently, directionally rotated about a fixed axis.

The electrostatic spraying unit of the invention connects to a tractor with a three-point-hitch and hitch pins. The drive line of the tractor connects to the front of the apparatus through the protective PTO collar 2. The on board air supply system, powered by the PTO of the tractor, is composed of a compact, high-efficiency supercharger 19, gear box assembly 22 containing a gear multiplier, air pre-cleaner 1, air filter, oil reservoir, oil filter and an oil intercooler. Air is supplied to individual nozzles from the supercharger through tubing attached to an orifice located in the back of the nozzle body 42. The low pressure, high volume gas flow produced is used, in this embodiment, to aerodynamically convey the droplets a significant distance in a turbulent stream to maximize target impingement and entrapment, particularly for complex target geometries.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. An induction electrostatic spray apparatus comprising:

a backpack structure defining one or more interior compartments, the backpack structure comprising an outer shell having an inner surface, an outer surface, one or more orifices, and one or more doors;

a battery contained within one of the one or more interior compartments of the backpack structure;

a chemical reservoir;

an airflow generation component contained within one of the one or more interior compartments of the backpack structure and operably coupled to the battery;

an electrostatic spray nozzle external to the backpack structure and operably coupled to the battery, chemical reservoir and airflow generation component;

a controller contained within one of the one or more interior compartments of the backpack structure and operably coupled to the battery; and one or more cooling fans operably coupled to the battery and configured to cool the one or more interior compartments, wherein the one or more cooling fans are mounted on the inner surface of the outer shell and positioned to cover the one or more orifices;

wherein actuation of the electrostatic spray nozzle by a user of the induction electrostatic spray apparatus causes atomization of a fluid flow from the chemical reservoir, electrostatic charging of the atomized fluid flow, and discharging of the electrostatically charged atomized fluid flow from the electrostatic spray nozzle.

2. The apparatus of claim 1, wherein the airflow generation component and the battery are contained within different interior compartments.

3. The apparatus of claim 1, wherein the battery comprises lithium.

4. The apparatus of claim 3, wherein the battery is a lithium iron phosphate battery.

5. The apparatus of claim 1, wherein the battery is operable to supply from 10-20 Amperes of direct current during an operating time of from 1-5 hours.

6. The apparatus of claim 1, wherein at least one of the one or more doors comprises a zipper.

7. The apparatus of claim 1, wherein the airflow generation component is in the form of an air compressor.

8. The apparatus of claim 1, wherein the backpack structure further comprises a set of straps operable for mounting the apparatus on a user's back.

* * * * *